US006158641A

United States Patent [19]

Eyman et al.

[11] Patent Number: 6,158,641

[45] Date of Patent: Dec. 12, 2000

[54] FOLDING FRAME CHILD CARRIER

[75] Inventors: David W. Eyman; Jennifer A. Kelley; Thomas J. Schmidlin, all of Cincinnati, Ohio

[73] Assignee: InSTEP, LLC, Mendota Heights, Minn.

[21] Appl. No.: 09/268,008

[22] Filed: Mar. 15, 1999

[51] Int. Cl.[7] ..... A45F 4/00

[52] U.S. Cl. ..... 224/577; 224/161; 224/634; 224/637; 297/118

[58] Field of Search ..... 224/161, 155, 224/634, 637, 575, 576, 577; 297/118

[56] References Cited

U.S. PATENT DOCUMENTS

| | | | |
|---|---|---|---|
| D. 357,438 | 4/1995 | Hsia . | |
| 3,610,489 | 10/1971 | Parsons | 224/161 |
| 3,984,115 | 10/1976 | Miller . | |
| 3,989,173 | 11/1976 | Gebhard | 224/155 |
| 4,157,837 | 6/1979 | Kao . | |
| 4,586,721 | 5/1986 | Harada . | |
| 4,746,044 | 5/1988 | Arvizu et al. | 224/161 |
| 4,747,526 | 5/1988 | Launes | 224/155 |
| 4,762,256 | 8/1988 | Whitaker | 224/155 |
| 4,915,401 | 4/1990 | Severson . | |
| 5,609,279 | 3/1997 | O'Shea | 224/155 |
| 5,626,271 | 5/1997 | Messey et al. | 224/161 |
| 5,676,287 | 10/1997 | Huang | 224/161 |
| 5,704,523 | 1/1998 | Wang | 224/161 |
| 5,954,253 | 9/1999 | Swetish | 224/631 |

*Primary Examiner*—Stephen P. Garbe
*Attorney, Agent, or Firm*—Gerald E. Helgert; Rider, Bennett, Egan & Arundel

[57] ABSTRACT

A folding child frame carrier for carrying a child on a person's back, comprising: a collapsible front frame portion, the front frame portion having a longitudinal axis and a transverse axis, the front frame portion being symmetrical about the longitudinal axis and having a left side and a right side, and the front frame portion being collapsible about the longitudinal axis and the transverse axis from an extended position to a contracted position, the front frame portion having an upper portion, a lower portion, and a forward-extending portion, the forward-extending portion being pivotally connected to the upper portion at a first pivot point, and the upper portion being pivotally connected to the lower portion at a second pivot point; a flexible child holder attached to the front frame portion between the upper portion and the forward-extending portion; a rear frame portion also symmetrical about the longitudinal axis and having a forward end pivoting on the front frame portion at a third pivot point and a rearward end, and movable between a stand position in which the rearward end is substantially separated from the front frame portion's lower portion and a carrier position in which the rearward end is adjacent the front frame portion's lower portion; and a locking means for holding the front frame portion in the extended position.

21 Claims, 5 Drawing Sheets

FOLDING FRAME CHILD CARRIER

BACKGROUND OF THE INVENTION

With the resurgence of physical fitness, persons of all ages, including the parents of infants and young children, have developed great interest in all forms of physical exercise, particularly in jogging, walking, or hiking. Today's active parents demand a child carrier that can be carried on the parent's back. However, earlier child carriers were not collapsible, and it was therefore awkward to transport them.

There is a need for a frame child carrier that can be stowed in a tote sack for ease of use and retail merchandising. Frequently, parents get tired of carrying their children in their arms, or the children get tired of walking, and it is inconvenient to wear a child carrier to prepare for such an eventuality. The unit should be compact enough to stow in a purse, diaper bag, or car and carried with other needed child-tending equipment. When unfolded for use, the unit must be sturdy and free from the possibility of inadvertent collapse, which could injure the child. The unit should also have the capability of being easily converted between a stand configuration in which it is self-supporting on a table and a carrier configuration in which the supporting legs are folded out of the way.

SUMMARY OF THE INVENTION

A folding frame child carrier for carrying a child on a person's back, comprising: a collapsible front frame portion, the front frame portion having a longitudinal axis and a transverse axis, the front frame portion being symmetrical about the longitudinal axis and having a left side and a right side, and the front frame portion being collapsible about the longitudinal axis and the transverse axis from an extended position to a contracted position, the front frame portion having an upper portion, a lower portion, and a forward-extending portion, the forward-extending portion being pivotally connected to the upper portion at a first pivot point, and the upper portion being pivotally connected to the lower portion at a second pivot point; a flexible child holder attached to the front frame portion between the upper portion and the forward-extending portion; a rear frame portion also symmetrical about the longitudinal axis and having a forward end pivoting on the front frame portion at a third pivot point and a rearward end, and movable between a stand position in which the rearward end is substantially separated from the front frame portion's lower portion and a carrier position in which the rearward end is adjacent the front frame portion's lower portion; and a locking means for holding the front frame portion in the extended position.

A principal object and advantage of the present invention is that it can be collapsed to a size that is easily transportable in a purse or diaper bag.

Another principal object and advantage of the present invention is that when locked open, it cannot be inadvertently folded, thus protecting the child against injury.

Another principal object and advantage of the present invention is that it is self-supporting when stood on a table so that the child can be placed in the carrier, then the parent can place his or her arms through the shoulder straps while the carrier is on the table. When the waist belt is buckled, the rear legs fold against the front legs so that they are out of the way.

BRIEF DESCRIPTION OF THE DRAWINGS

FIG. 2 is a perspective view of the foldable child carrier of the present invention in place on a person's back with a child present in the carrier, as shown in phantom;

FIG. 12 is a cross-section along the lines 12 of FIG. 11.

DETAILED DESCRIPTION OF THE PREFERRED EMBODIMENTS

Figure 1:
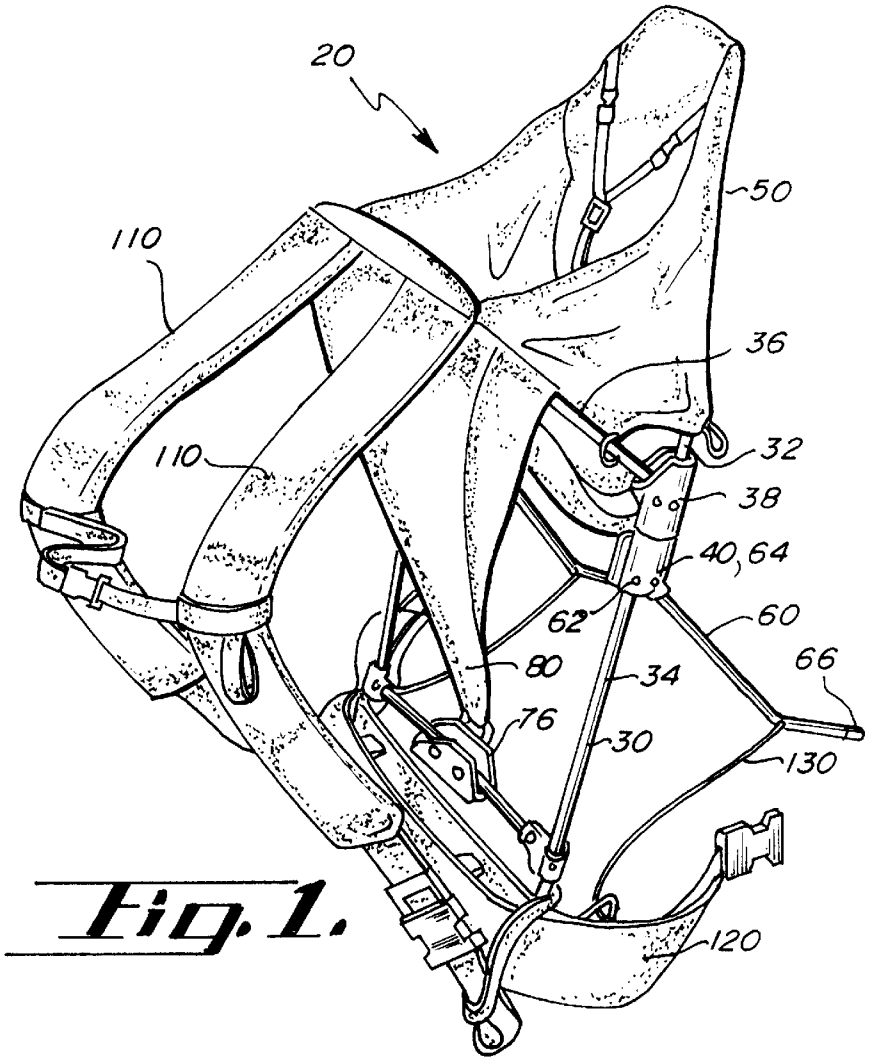
FIG. 1 is a perspective view of the foldable child carrier of the present invention.
Figure 6:
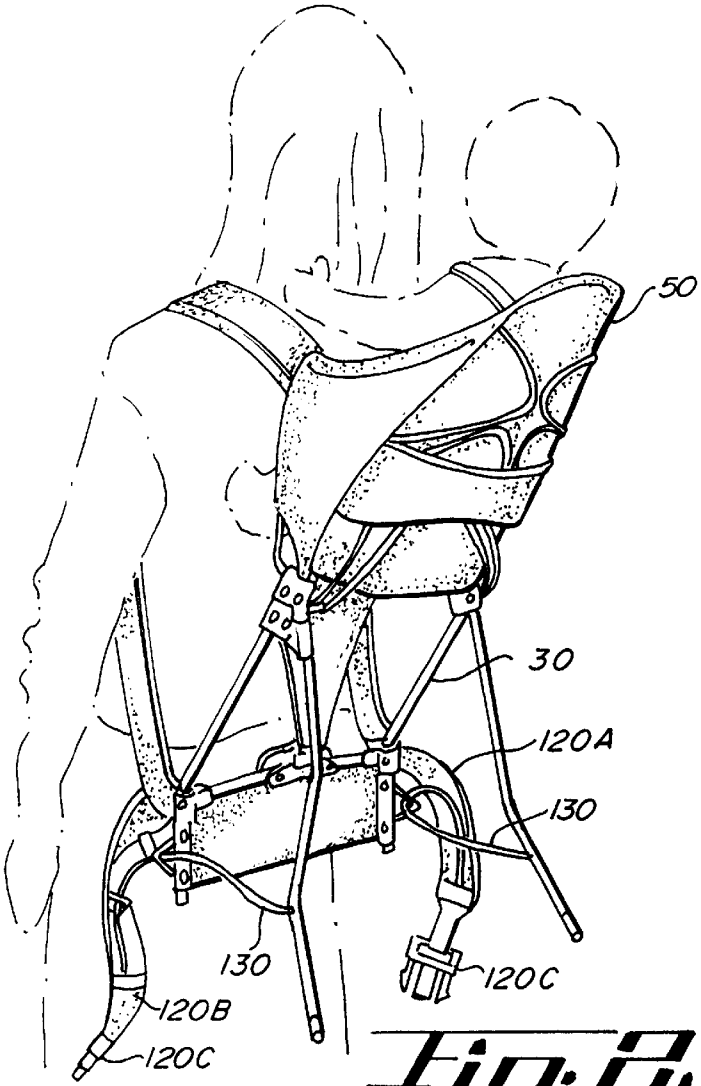
FIG. 6 is similar to FIG. 5, showing the next step in folding the frame.

The folding frame child carrier of the present invention is generally shown in the Figures as reference numeral 20.

Figure 4:
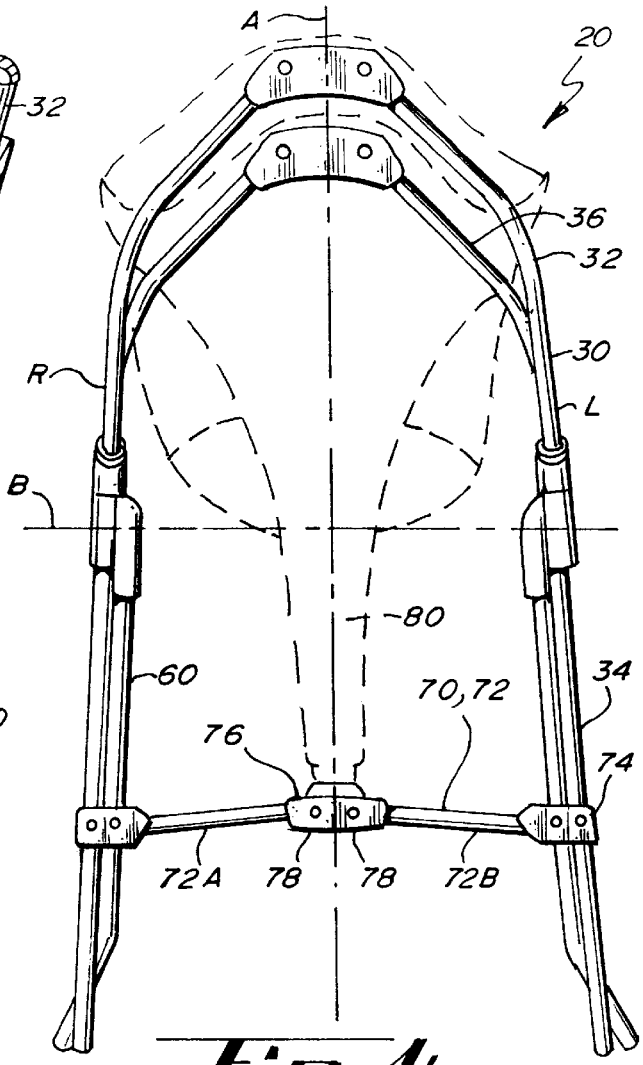
FIG. 4 is a front elevational view of the foldable child carrier of the present invention with the child holder shown in phantom.
Figure 9:
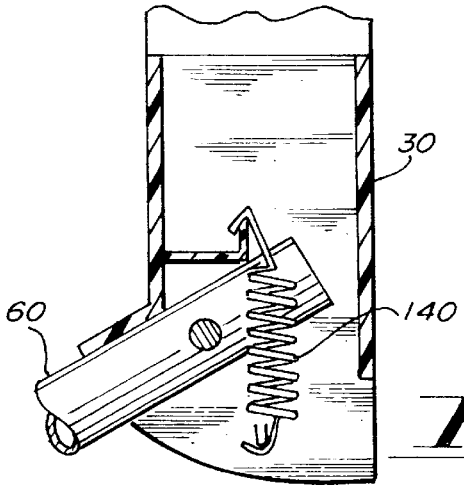
FIG. 9 is a detailed section of the connection between the front frame portion and rear frame portion.
Figure 7:
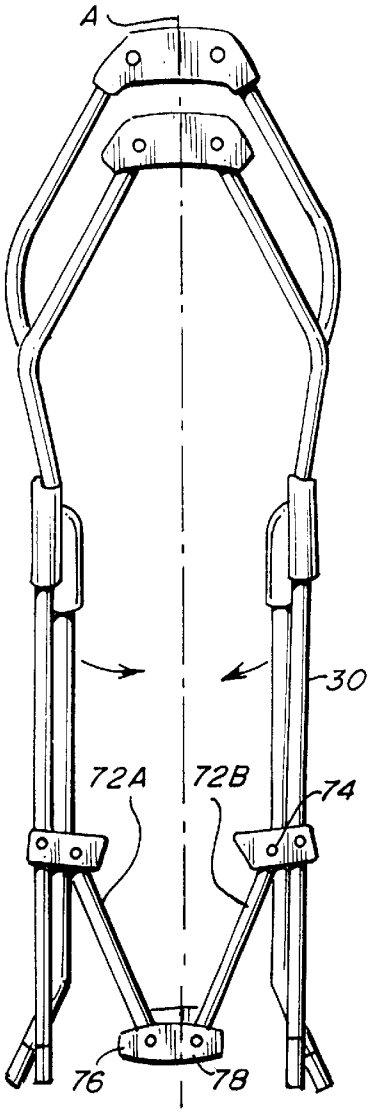
FIG. 7 is similar to FIG. 4, showing the next step in folding the frame.
Figure 8:
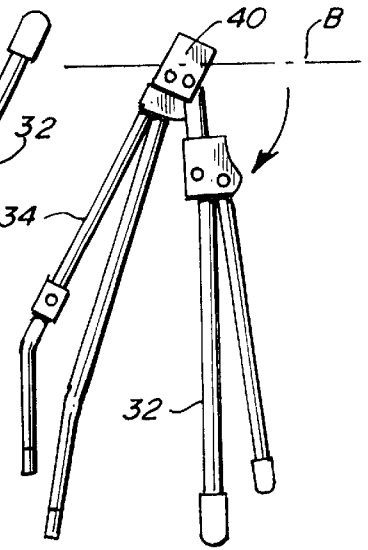
FIG. 8 is similar to FIG. 5, showing the next step in folding the frame.
Figure 6:
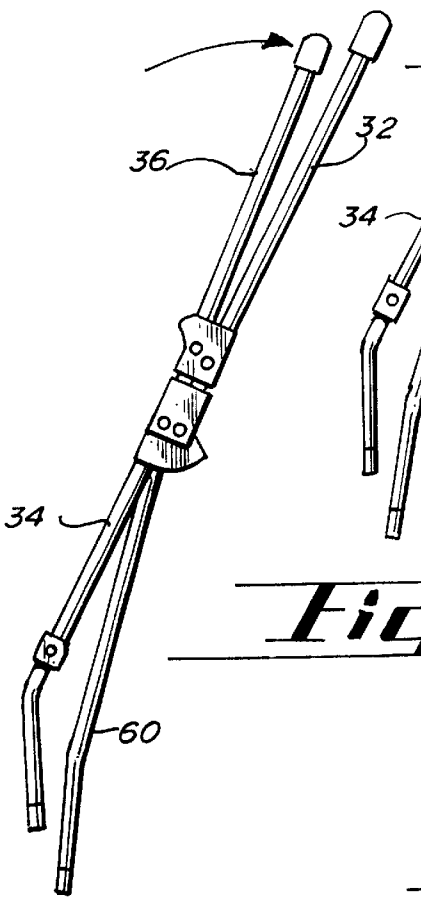
Figure 5:
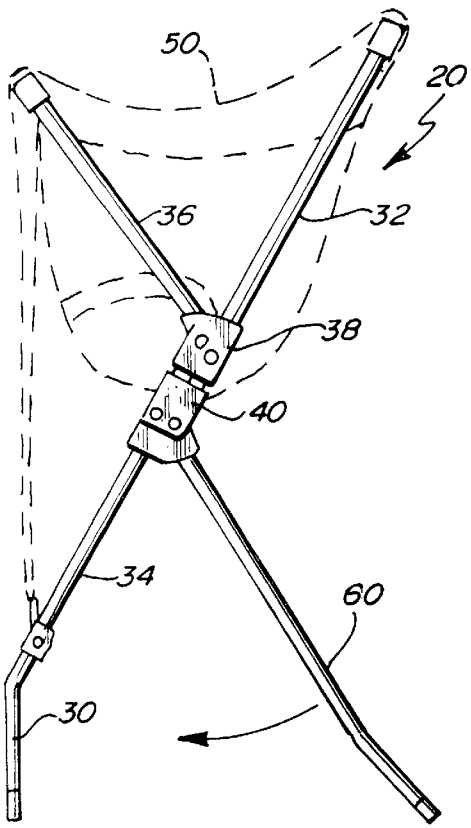
FIG. 5 is a left side elevational view of the foldable child carrier of the present invention, showing the first step of folding the frame.

The folding frame child carrier 20 comprises a collapsible front frame portion 30 having a longitudinal axis A and a transverse axis B, the front frame portion 30 being symmetrical about the longitudinal axis A and having a left side L and right side R. The front frame portion 30 is collapsible about the longitudinal axis A and transverse axis B from an extended position (FIG. 4) to a contracted position (FIG. 8).

The front frame portion 30 has an upper portion 32, a lower portion 34, and a forward-extending portion 36. The forward-extending portion 36 is pivotally connected to the upper portion 32 at a first pivot point 38. The upper portion 32 is pivotally connected to the lower portion 34 at a second pivot point 40.

A flexible child holder 50 is attached to the front frame portion 30 between the upper portion 32 and the forward-extending portion 36.

A rear frame portion 60 is symmetrical about the longitudinal axis A of the front frame portion 30 and has a forward end 62 pivoting on the front frame portion 30 at a third pivot point 64 and a rearward end 66. The rear frame portion 60 is movable between a stand position (FIGS. 1 and 2) in which the rearward end 66 is substantially separated from the front frame portion's lower portion 34 and a carrier position (FIG. 3) in which the rearward end 66 is adjacent the front frame portion's lower portion 34.

The folding frame child carrier 20 also comprises a locking means 70 for holding the front frame portion 30 in the extended position.

In one aspect of the invention, the locking means 70 cooperates with the forward-extending portion 36 to lock the upper portion 32 to the lower portion 34 when the forward-extending portion 36 is pivoted away from the upper portion 32; and to unlock the upper portion 32 from the lower portion 34 when the forward-extending portion 36 is pivoted toward the upper portion 32.

In the preferred embodiment, the locking means 70 further comprises a pivoting cross-brace 72 comprising two segments 72A, 72B connected to each side of the front frame portion 30 at fourth pivot points 74. The segments 72A, 72B are pivotally connected to an over-center lock 76 at fifth pivot points 78. The over-center lock 76 is preferably kept from pivoting while in the extended position by a strap hook 80 attached to the forward-extending portion 36.

The locking means 70 also preferably comprises a pair of latches 90 interconnecting the upper portion 32 to the lower portion 34. The latches 90 may preferably further comprise a movable member 92 attached to the upper portion 32 and a stationary member 94 attached to the lower portion 34. The movable member 92 mates with the stationary member 94 when the forward-extending portion 36 is pivoted away from the upper portion 32 about the first pivot point 38. Most preferably, both the upper portion 32 and the lower portion 34 are hollow, with the movable member 92 slidingly engaged within the upper portion 32 and the stationary member 94 being a recess 96 formed within the lower member 34.

Figures 3, 10, 11:
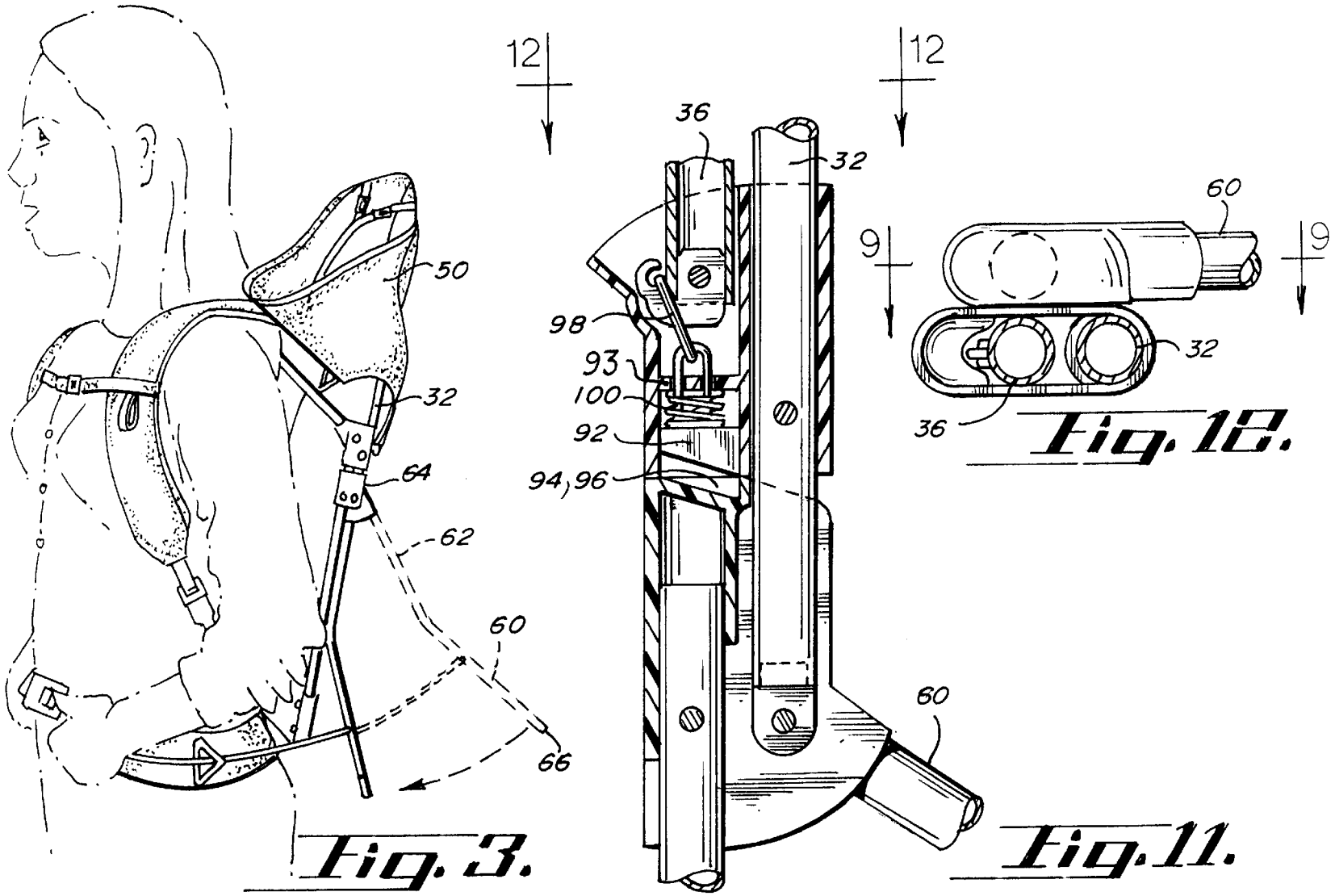
FIG. 3 is a perspective view of the foldable child carrier of the present invention in place on a person's back, showing the folding of the rear frame portion as the belt is pulled forwardly.
FIG. 10 is a detailed section of the front frame portion, with some structure cut away to show internal detail.
FIG. 11 is similar to FIG. 10, but with the pivot point latches unlocked.
Figure 10:
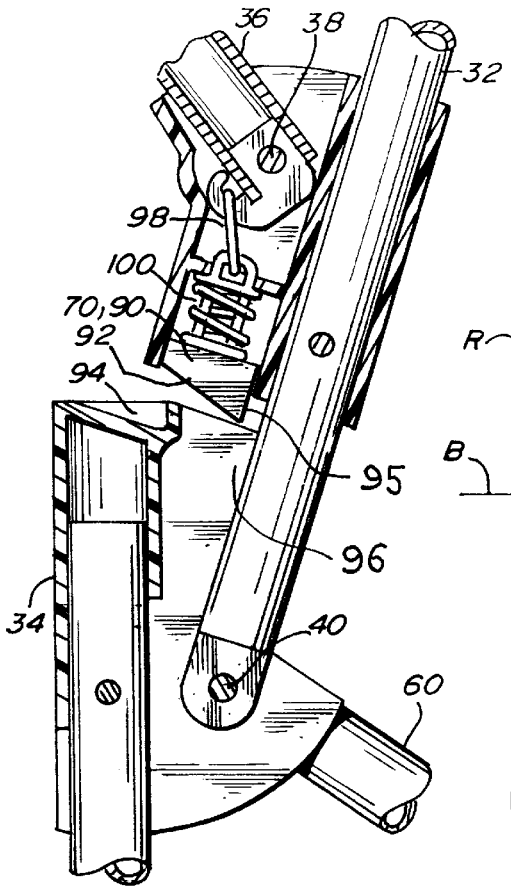

To connect the forward-extending portion 36 to the latches 90, the locking means 70 also preferably comprises a pivot link 98 connecting the movable member 92 to the forward-extending portion 36 and a spring 100 urging the movable member 92 away from the pivot link as seen in FIG. 11, movement of the forward-extending portion 36 toward the lower portion 32 compresses the spring 100 between the movable member 92 and stop 93. Compression of the spring 100 allows the movable member 92 to separate from the stationary member 94 or recess 96. This unlocks the upper portion 32 from the lower portion 34. Conversely in the preferred embodiment, movement of the forward-extending portion 36 away from the upper portion 32 about upper pivot point 38 (FIG. 10) moves the pivot link 98 forwardly, releasing tension on the spring 100 and allowing the spring 100 to urge the movable member 92 toward the stationary member 94.

Figure 10A:
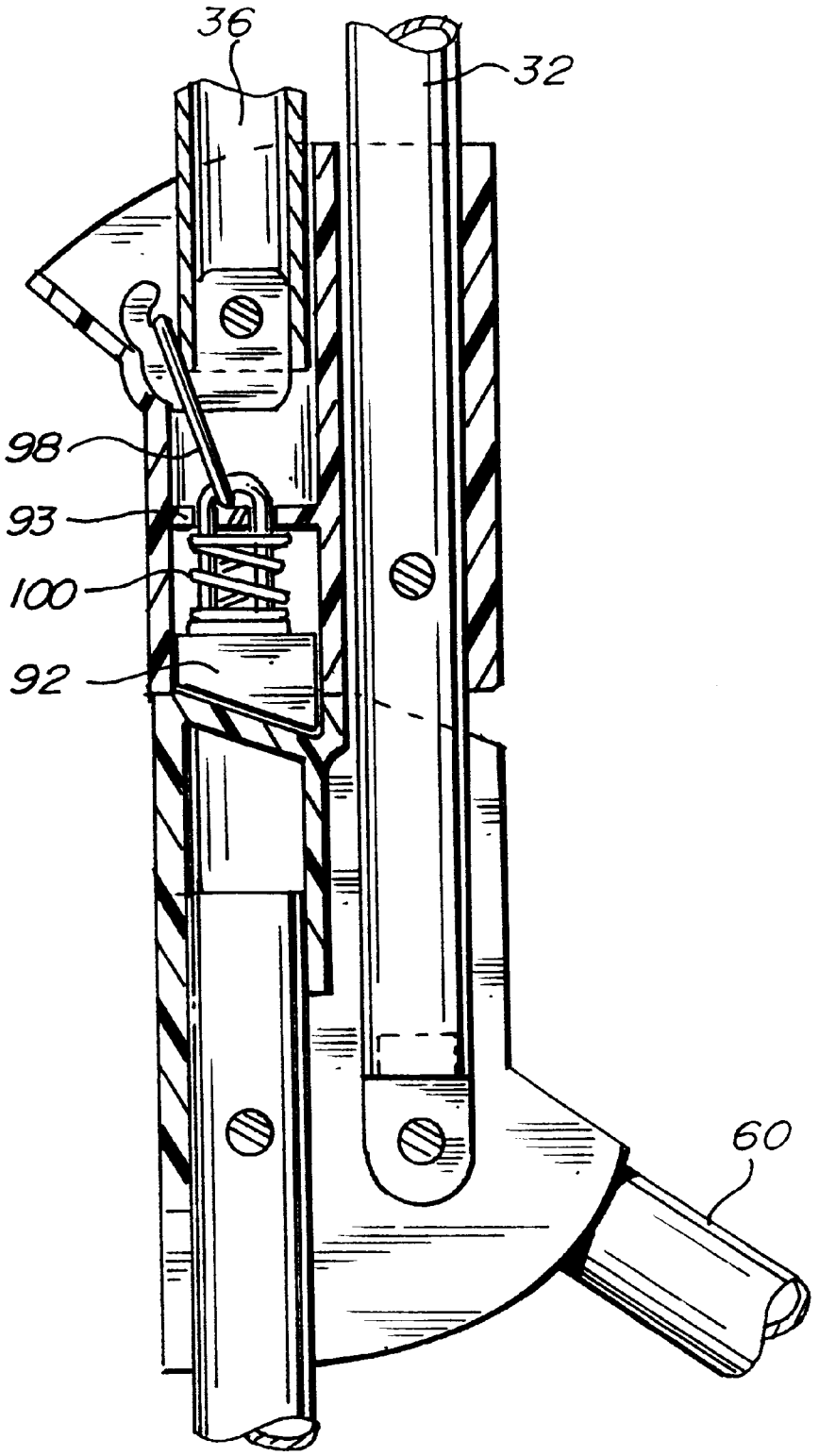
FIG. 10A is a detailed section of movable member 92 in mating relationship with stationary member 94.

It will be understood by one of ordinary skill in the art that, in the preferred embodiment, movement of the upper member 32 toward the lower member 34 will cause the tip 95 of the movable member 92 to ride along the ramp 96 in lower portion 34, urged against the ramp 96 by the spring 100, until the movable member 92 mates with the stationary member 94. FIG. 10*a* shows the upper portion 32 locked to the lower portion 34.

The folding frame child carrier 20 also preferably comprises two padded, adjustable shoulder straps 110 secured between the forward-extending portion 36 and the lower portion 34.

In another aspect of the invention, the folding frame child carrier 20 comprises a padded, adjustable waist belt 120 attached to the lower portion 34, the belt further comprising two straps 120A, 120B connected the two sides of the lower portion 36, and each strap having a buckle 120C.

In another aspect of the invention, the folding frame child carrier 20 further comprises a pair of flexible linkages 130 connected to the straps 120A, 120B near the buckles 120C, and each linkage is also connected to one side of the rear frame portion 60 at the rearward end 66 so that as the straps 120A, 120B are brought forward to secure the carrier 20 about the waist, the linkages 130 pull the rearward end 66 toward the front frame portion 30, to the carrier position. The carrier 20 also comprises a spring 140 attached to the front frame portion 30 and the rear frame portion 60, and urging the rear frame portion 60 away from the front frame portion 30 when the straps 120A, 120B are released.

FIGS. 5–8 show the process of folding the child carrier 20. First, the rear frame portion 60 is brought forward adjacent the front frame portion 30 (FIG. 5), as shown by the arrow. Then the forward-extending portion 36 is brought toward the upper portion 32, as shown by the arrow in FIG. 6, releasing the latches 90 as described above. Next, the strap hook 80 is released from the over-center lock 76 and the front frame portion 30 is collapsed about the longitudinal axis A (FIG. 7), as shown by the arrows. It will be seen that this motion is allowed by the segments 72A, 72B of the cross-brace 72 pivoting at points 74 and 78. Next, the upper portion 32 is pivoted about the second pivot point 40 (FIG. 8), folding the frame carrier 20 about the transverse axis B.

In the contracted position (FIG. 8), the belt 120 may be wrapped around the upper portion 32, lower portion 34, and forward-extending portion to hold the frame carrier 20 in the contracted position.

When in the extended position (FIGS. 1 and 2), the frame carrier 20 may be placed on a table and the child may be placed in the child holder 50. The parent may then don the frame carrier 20 and buckle the straps 120, pulling the rear frame portion 60 toward the front frame portion 30 (FIG. 3).

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A folding frame child carrier for carrying a child on a person's back, comprising:

a) a collapsible front frame portion, the front frame portion having a longitudinal axis and a transverse axis, the front frame portion being symmetrical about the longitudinal axis and having a left side and a right side, and the front frame portion being collapsible about the longitudinal axis and the transverse axis from an extended position to a contracted position, the front frame portion having an upper portion, a lower portion, and a forward-extending portion, the forward-extending portion being pivotally connected to the upper portion at a first pivot point, and the upper portion being pivotally connected to the lower portion at a second pivot point;

b) a flexible child holder attached to the front frame portion between the upper portion and the forward-extending portion;

c) a rear frame portion also symmetrical about the longitudinal axis and having a forward end pivoting on the front frame portion at a third pivot point and a rearward end, and movable between a stand position in which the rearward end is substantially separated from the front frame portion's lower portion and a carrier position in which the rearward end is adjacent the front frame portion's lower portion; and d) a locking means for holding the front frame portion in the extended position.

2. A folding frame child carrier for carrying a child on a person's back, comprising:

a) a collapsible front frame portion, the front frame portion having a longitudinal axis and a transverse axis, the front frame portion being symmetrical about the longitudinal axis and having a left side and a right side, and the front frame portion being collapsible about the longitudinal axis and the transverse axis from an extended position to a contracted position, the front frame portion having an upper portion, a lower portion, and a forward-extending portion, the forward-extending portion being pivotally connected to the upper portion at a first pivot point, and the upper portion being pivotally connected to the lower portion at a second pivot point;

b) a flexible child holder attached to the front frame portion between the upper portion and the forward-extending portion;

c) a rear frame portion also symmetrical about the longitudinal axis and having a forward end pivoting on the front frame portion at a third pivot point and a rearward end, and movable between a stand position in which the rearward end is substantially separated from the front frame portion's lower portion and a carrier position in which the rearward end is adjacent the front frame portion's lower portion; and d) a locking means for holding the front frame portion in the extended position, the locking means cooperating with the forward-extending portion to lock the upper portion to the lower portion when the forward-extending portion is pivoted away from the upper portion, and to unlock the upper portion from the lower portion when the forward-extending portion is pivoted toward the upper portion.

3. The folding frame child carrier of claim 2, further comprising two padded, adjustable shoulder straps secured between the forward-extending portion and the lower portion.

4. The folding frame child carrier of claim 2, further comprising a padded, adjustable waist belt attached to the lower portion, the belt further comprising two straps, one of the straps connected to each side of the lower portion and each strap having a buckle.

5. The folding frame child carrier of claim 4, further comprising a pair of flexible linkages connected to each strap near the buckle, each flexible linkage also connected to one side of the rearward end of the rear frame portion and adapted to move the rearward end between the stand position and the carrier position when the straps are pulled forwardly away from the frame carrier.

6. The folding frame child carrier of claim 5, further comprising a first spring attached to the front frame portion and the rear frame portion, the first spring urging the rear frame portion away from the front frame portion.

7. The folding frame child carrier of claim 2, wherein the locking means further comprises a cross-brace between the two sides of the lower frame portion, the cross-brace comprising two segments pivotally connected at an over-center lock; and a pair of latches interconnecting the upper portion and lower portion.

8. The folding frame child carrier of claim 7, further comprising a strap hook attached to the forward-extending portion and removably engaging the over-center lock.

9. The folding frame child carrier of claim 7, wherein the latches each further comprise a movable member attached to the upper portion and a stationary member attached to the lower portion, the movable member mating with the stationary member when the forward-extending portion is pivoted away from the upper portion about the first pivot point.

10. The folding frame child carrier of claim 9, wherein both the upper portion and lower portion are hollow, the movable member being slidingly engaged within the upper portion and the stationary member being a recess formed within the lower member.

11. The folding frame child carrier of claim 10, further comprising a pivot link connecting the movable member to the forward-extending portion and a second spring urging the movable member away from the pivot link, whereby movement of the forward-extending portion toward the upper portion compresses the spring and separates the movable member from the stationary member.

12. A folding frame child carrier for carrying a child on a person's back, comprising:

a) a collapsible front frame portion, the front frame portion having a longitudinal axis and a transverse axis, and the front frame portion being collapsible about the longitudinal axis and the transverse axis from an extended position to a contracted position, the front frame portion having an upper portion, a lower portion, and a forward-extending portion, the forward-extending portion being pivotally connected to the upper portion at a first pivot point, and the upper portion being pivotally connected to the lower portion at a second pivot point;

b) a flexible child holder attached to the front frame portion between the upper portion and the forward-extending portion;

c) a rear frame portion having a forward end pivoting on the front frame portion at a third pivot point and a rearward end, and movable between a stand position in which the rearward end is substantially separated from the front frame portion's lower portion and a carrier position in which the rearward end is adjacent the front frame portion's lower portion;

d) a pivoting cross-brace for holding the front frame portion in the extended position across the transverse axis; and e) latches cooperating with the forward-extending portion to lock the upper portion to the lower portion when the forward-extending portion is pivoted away from the upper portion, and to unlock the upper portion from the lower portion when the forward-extending portion is pivoted toward the upper portion.

13. The folding frame child carrier of claim 12, further comprising two padded, adjustable shoulder straps secured between the forward-extending portion and the lower portion.

14. The folding frame child carrier of claim 12, further comprising a padded, adjustable waist belt attached to the lower portion, the belt further comprising two straps, one of the straps connected to each side of the lower portion and each strap having a buckle.

15. The folding frame child carrier of claim 14, further comprising a pair of flexible linkages connected to each strap near the buckle, each flexible linkage also connected to one side of the rearward end of the rear frame portion and adapted to move the rearward end between the stand position and the carrier position when the straps are pulled forwardly away from the frame carrier.

16. The folding frame child carrier of claim 15, further comprising a first spring attached to the front frame portion and the rear frame portion, the first spring urging the rear frame portion away from the front frame portion.

17. The folding frame child carrier of claim 12, the cross-brace comprising two segments pivotally connected at an over-center lock; and a pair of latches interconnecting the upper portion and lower portion.

18. The folding frame child carrier of claim 17, further comprising a strap hook attached to the forward-extending portion and removably engaging the over-center lock.

19. The folding frame child carrier of claim 17, wherein the latches each further comprise a movable member attached to the upper portion and a stationary member attached to the lower portion, the movable member mating with the stationary member when the forward-extending portion is pivoted away from the upper portion about the first pivot point.

20. The folding frame child carrier of claim 19, wherein both the upper portion and lower portion are hollow, the movable member being slidingly engaged within the upper portion and the stationary member being a recess formed within the lower member.

21. The folding frame child carrier of claim 20, further comprising a pivot link connecting the movable member to the forward-extending portion and a second spring urging the movable member away from the pivot link, whereby movement of the forward-extending portion toward the upper portion compresses the spring and separates the movable member from the stationary member.

* * * * *